US009982979B2

(12) United States Patent
Graswald

(10) Patent No.: US 9,982,979 B2
(45) Date of Patent: May 29, 2018

(54) DEVICE AND METHOD FOR CONTROLLED FRAGMENTATION BY MEANS OF TEMPERATURE-ACTIVATABLE NOTCH CHARGES

(71) Applicant: TDW Gesellschaft fuer verteidigungstechnische Wirksysteme mbH, Schrobenhausen (DE)

(72) Inventor: Markus Graswald, Pfaffenhofen an der lim (DE)

(73) Assignee: TDW Gesellschaft fuer verteidgungstechnische Wirksysteme mbH, Schrobenhausen (DE)

( * ) Notice: Subject to any disclaimer, the term of this patent is extended or adjusted under 35 U.S.C. 154(b) by 0 days. days.

(21) Appl. No.: 14/871,555

(22) Filed: Sep. 30, 2015

(65) Prior Publication Data

US 2016/0097620 A1 Apr. 7, 2016

(30) Foreign Application Priority Data

Oct. 1, 2014 (DE) ..... 10 2014 014 332

(51) Int. Cl.
*F42B 12/22* (2006.01)
*F42B 1/02* (2006.01)

(52) U.S. Cl.
CPC ..... *F42B 12/22* (2013.01); *F42B 1/02* (2013.01)

(58) Field of Classification Search
CPC ..... F42B 12/10; F42B 12/20; F42B 12/208; F42B 12/22; F42C 19/0838; F42C 19/0846; F42C 19/095
USPC ..... 102/473, 475, 476, 478, 491, 492, 493, 102/494, 495, 496, 497
See application file for complete search history.

(56) References Cited

U.S. PATENT DOCUMENTS 3,135,205 A * 6/1964 Zwicky ..... C06B 45/12 102/476
3,212,439 A * 10/1965 Reyne ..... F42B 3/124 102/202.14
4,314,614 A * 2/1982 McPhee ..... E21B 43/1185 102/260
4,516,501 A 5/1985 Held et al.
4,662,281 A 5/1987 Wilhelm et al.
4,938,143 A * 7/1990 Thomas ..... F42B 3/10 102/275.4

(Continued)

FOREIGN PATENT DOCUMENTS

DE 29 41 480 A1 4/1980
DE 30 16 861 A1 11/1981

(Continued)

OTHER PUBLICATIONS

Mohammad H. Keshavarz, Detonation temperature of high explosives from structural parameters, Oct. 11, 2006, Internet Article, Journal of Hazardous Materials, vol. 137, Issue 3, pp. 1303-1308, found on the internet at: http://Cwww.sciencedirect.com/science/article/pii/S0304389406004584?np=y.*

(Continued)

*Primary Examiner* — Bret Hayes
(74) *Attorney, Agent, or Firm* — Crowell & Moring LLP

(57) ABSTRACT

A device for the controlled breakdown of the shell of a warhead, wherein, by exploiting the hollow charge effect, the shell is substantially weakened and/or penetrated in the affected areas, thus enabling fragments of a desired size to form.

23 Claims, 2 Drawing Sheets

(56) References Cited

U.S. PATENT DOCUMENTS

| | | | | |
|---|---|---|---|---|
| 5,129,326 | A * | 7/1992 | Brogan | F42B 39/20 102/481 |
| 5,204,493 | A * | 4/1993 | Christmann | F42B 1/024 102/307 |
| 5,880,399 | A * | 3/1999 | Hales | C06B 23/003 149/2 |
| 7,891,297 | B1 | 2/2011 | Rohr | |
| 8,082,846 | B2 | 12/2011 | Cook et al. | |
| 8,272,329 | B1 | 9/2012 | Hsieh et al. | |
| 8,272,330 | B1 | 9/2012 | Gold et al. | |
| 8,276,520 | B1 | 10/2012 | Fong et al. | |
| 8,627,771 | B1 | 1/2014 | Gold | |
| 2002/0088363 | A1* | 7/2002 | Menzel | F42B 3/124 102/275.7 |
| 2004/0216822 | A1* | 11/2004 | Hofmann | C06B 21/0083 149/92 |
| 2007/0095239 | A1* | 5/2007 | Skinner | F42B 39/14 102/481 |
| 2010/0096136 | A1* | 4/2010 | Bourne | F42B 1/032 166/299 |
| 2010/0263566 | A1* | 10/2010 | Ruhlman | F42B 1/028 102/499 |
| 2011/0146517 | A1* | 6/2011 | Wuensche | F42B 3/10 102/200 |
| 2013/0239837 | A1* | 9/2013 | Ames | F42B 12/208 102/478 |

FOREIGN PATENT DOCUMENTS

| | | | |
|---|---|---|---|
| DE | 101 15 950 | C1 | 6/2002 |
| DE | 10 2013 011 404 | A1 | 1/2015 |
| DE | 10 2013 011 786 | A1 | 1/2015 |
| EP | 1 225 416 | A1 | 7/2002 |
| EP | 2 133654 | A2 | 12/2009 |
| EP | 2 336 710 | A2 | 6/2011 |

OTHER PUBLICATIONS

Author Unknown, Pyrofuze, 2016, Sigmond Cohn Corp., p. 1, found here: http://www.sigmundcohn.com/pyrofuze.*

European Search Report issued in European counterpart application No. 15 00 2816 dated Jan. 28, 2016, with Statement of Relevancy (Three (3) pages).

* cited by examiner

DEVICE AND METHOD FOR CONTROLLED FRAGMENTATION BY MEANS OF TEMPERATURE-ACTIVATABLE NOTCH CHARGES

CROSS REFERENCE TO RELATED APPLICATION

This application claims priority under 35 U.S.C. § 119 from German Patent Application No. 10 2014 014 332.5, filed Oct. 1, 2014.

BACKGROUND AND SUMMARY OF THE INVENTION

Current and presumably also future deployment scenarios require, as a matter of principle, a high level of flexibility in the use of missiles, projectiles and bombs, insofar as they are to be deployed against targets on or near the ground and can particularly be located in an urban environment.

For this purpose, effector system concepts, among other things, have been proposed in which flexible power control is enabled with the aid of two initiation devices for controlled deflagration and classic detonation of the blasting charge. It is thus possible to implement different modes of action, ranging from mere deflagration, as the smallest effect, to time-staggered combined reaction mechanisms, as intermediate effect, to detonation as the greatest effect.

In subdetonative output modes, particularly in the smallest mode of the deflagration of the blasting charge, relatively large fragments occur during disintegration of the shell, which can be attributed to low quasistatic pressures. This results in two drawbacks. For one, the fragment density is so low in these cases that military targets cannot be hit and damaged or destroyed even if they are in short range. For another, large fragment masses, in combination with low fragment speeds, increase the damage ranges of the warhead, which can be undesirable, particularly in the case of noncombatant/military persons and objects. The so-called collateral damage ranges are thus enlarged.

The size and shape of the fragments, besides on the blasting charge and the ignition thereof, depends substantially on the L/D ratio of the warhead and the material characteristics of the warhead shell. These are the wall thickness and quasistatic characteristics such as tensile strength, tensile yield point and elongation at rupture. The stresses occurring as a result of the expansion of the shell in the circumferential direction lead to typical shear fractures. Particularly in metals with a low tensile strength and ductile behavior (high tensile yield point and elongation at rupture) and/or cylindrical shells, the shell fragments can be very long and even extend over the entire length of the warhead shell.

Passive measures for the controlled breakdown of fragments such as the weakening of the warhead shell and/or additional inert inserts between shell and blasting charge work only under certain conditions. What is more, such measures may not be applicable in cases in which a given shell must be used and/or changes to the aerodynamic characteristics and/or physical characteristics (such as center of gravity, mass and moments of inertia) of the shell are not possible for reasons of compatibility. This practically rules out the use of such described passive measures from the outset.

An object of the present invention is therefore a device which enables controlled fragment formation even under the pressures occurring in the smallest output mode. In this way, the fragment masses can be significantly reduced and, simultaneously, the fragment density increased. As a result, the effect against near-range military targets can be improved while simultaneously reducing collateral damage ranges.

It is known to use various devices in warheads in order to break the warhead or munitions shell down in a controlled manner into fragments of a desired size and mass even in the case of subdetonative outputs with significantly smaller pressures than in a detonation.

Passive measures such as notches in the outer shell have only limited success depending on the notch depth and the shell material, which often manifests itself as fragments that are larger than intended.

Passive measures in the form of various inserts between warhead shell and blasting charge, such as diamond pattern inserts, perforated inserts, and notched rings lead to similar difficulties during the controlled breakdown of the outer shell. However, some inserts work so well that they generate small, additional fragments which can improve the effect, particularly against soft, near-range targets.

On the whole, it turns out that a good separation of the fragments in the circumferential direction is possible in the manner in which they occur as a result of the expansion of the shell even in the case of small quasistatic pressures and expansion rates, such as in the smallest mode of action. What proves problematic is, above all, the breakdown in the axial direction, particularly in the case of disadvantageous material characteristics and shell shapes. This is particularly evident in the shell ends, where the breakdown is typically poorer than in the center of the shell, with greater reaction speeds and pressures.

PRIOR ART

DE 10 2013 011 404.7—Method and device for controlling power of an active system.

In this patent application, a method for controlling power is described for the first time which, unlike previous patents, introduces the two reaction mechanisms deflagration and detonation from the same side. The device leaves the specific design of the ignition system open.

DE 10 2023 011 786.0—Device for controlled initiation of the deflagration of a blasting charge.

In this application, the design of a deflagrator is specified as a function of various active component characteristics such as dimensions and damping. Relatively large and heavy fragments can occur even in the smallest mode of action.

It should be noted, however, that the use of metals such as high-strength steels with brittle characteristics, for example (low tensile yield point and elongation at rupture) and/or convexly curved shell shapes already leads to smaller fragments. This is because the breakdown in the axial direction then works better.

U.S. Pat. No. 8,272,330B1—Selectable size fragmentation warhead.

This document relates to a pair of cylindrical liners that can also be rotatable. Plastic is cited as the material. Various geometric shapes are cited as openings. Like in P700464, the problem arises that, when combined with initiation devices for producing subdetonative output modes, the pressures typically too small to break down the outer shell in a controlled manner. This applies particularly to the smallest mode of action with the deflagration of the blasting charge.

U.S. Pat. No. 8,272,329B1—Selectable lethality warhead patterned hole fragmentation insert sleeves.

This patent is explicitly geared toward round openings, with at least three inserts being named in the claims which, again, can be rotatable. The same drawbacks apply as cited previously.

U.S. Pat. No. 8,276,520B1—Adaptive fragmentation mechanism to enhance lethality.

Here, ring inserts are described which break down the outer shell upon detonative ignition with a hollow charge effect. It should be noted here that the effect upon deflagrative/subdetonative ignition does not lead to a hollow charge effect, since the deflagrative reaction mechanism does not generate any shock front with high pressures.

DETAILED DESCRIPTION OF THE DRAWINGS

Figure 1:
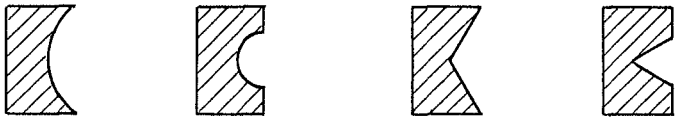
FIG. 1 depicts various examples of possible cross sections of the notch charges, in accordance with the principles of the invention.

The quasistatic pressures that occur during deflagration depend on the rates of energy dissipation in comparison to the energy generation. The plugging of the warhead through its shell and any lids also plays a role, as do structural measures for ventilation as well as the initial temperature of the blasting charge of the warhead and its surroundings.

Pursuant to its stated object, the device proposed in the framework of the invention is especially intended to substantially improve the axial breakdown of the shell into shorter and overall lighter fragments.

A device for the controlled breakdown of a shell of a warhead is disclosed. The device comprises a blasting charge and at least one temperature activated notch charge positioned on an interior surface of the warhead shell. The notch charge includes an energetic material. The notch charge is configured to weaken and breakdown the shell of the warhead in a controlled manner. The notch charge may be activated by exposure to temperatures typically occurring during combustion reactions and/or deflagrations of the blasting charge.

The cross section of the notch charge may have one of a round and conical shape. The opening radius or angle of the notch charge may be variable. The notch charge may have an insert made of an inert material. The insert may be enriched with a reactive material.

A length of the notch charge may be greater than a run-up distance at expected initiation pressures of an explosive of the notch charge. A diameter of the notch charge may be greater than a typical critical diameter in a field of application of the notch charge. An actual diameter of the blasting charge of the notch charge may be selected to be smaller than a critical diameter of a blasting charge of the warhead so as to avoid a sympathetic initiation.

The energetic material of the notch charge may have an explosive molecule comprising at least one of: RDX, HMX, PETN, HNS, Tetryl, and formulations thereof. The energetic material of the notch charge may have a propellant charge substance comprising at least one of: AP, AN, NM, NG, CP, PA, lead acid, and formulations thereof. The energetic material of the notch charge may be enriched with at least one of: (a) metal particles, such as aluminum or magnesium, (b) inert binders, (c) reactive binders and (d) additive substances, such as wax and/or graphite.

The energetic material of the notch charge may be pressed. The energetic material of the notch charge may be cast without hollow spaces. A density of the energetic material of the notch charge may lie near or clearly below the theoretical maximum density.

An ignition charge may also be arranged upstream from the energetic material of the notch charge. A temperature-sensitive explosive, comprising the explosive molecule, may be arranged upstream from the energetic material of the notch charge. A temperature-sensitive propellant charge, comprising the propellant charge substance, may be arranged upstream from the energetic material of the notch charge. The ignition charge may have a pyrotechnic formulation comprising at least one of: KNO3, Zr, Pb3O4, tetrazene, boron and strontium nitrate with Mg and additives. The term "upstream" as used herein is used with respect to the directed blast of the notch charge.

The ignition charge may be ignited by means of a hot gas.

At least one of the notch charge and the ignition charge may be damped with one or more layers of an inert material. A metal for plugging may be used as the inert material. A plastic or another inert and shock-damping material may be used for damping. A damping layer of inert material may be arranged between a main charge, the ignition charge and the notch charge.

One or more notch charges may be arranged on an interior of the shell of the warhead perpendicularly or obliquely to a shell surface. The one or more notch charges may be at least one of axially, transversely and obliquely arranged with respect to a main axis of the warhead in one or more of individually, several in parallel and in crisscrossing layers. A spacing of notch charges that are parallel and crossing at an angle may be established according to desired fragment sizes.

A method for the controlled breakdown of a shell of a warhead is further disclosed. The method includes denotatively igniting a notch charge by exposure to a high temperature and under exploitation of a deflagration-to-detonation transition effect. The method further includes the shell being weakened by a notch effect such that a controlled breakdown into fragments is enabled. A reaction and pressure may be produced by exposure of an upstream ignition charge to a high temperature. A detonative ignition of the notch charge may then be achieved by means of the deflagration-to-detonation transition effect.

According to the proposed solution, notch charges (also known as explosive notches, cut charges or linear hollow charges) are proposed that are located on the interior of the shell. By exploiting the hollow charge effect, the shell is substantially weakened and/or penetrated in the affected areas, thus enabling smaller fragments to form. Examples of possible cross sections of the notch charges are shown in FIG. 1, the possibilities not necessarily being limited thereto.

However, such notch charges do not work in their standard design (as shown in FIG. 1) because, in the case of the subdetonative ignition of the blasting charge, a detonation front with commensurately high reaction speeds and pressures does not usually occur. It is precisely for that case that a solution is to be proposed which enables reliable initiation of the notch charges.

To achieve this object, it is proposed according to the invention that the aforementioned notch charges are embodied so as to be temperature-activatable. Here, the fact is exploited that a multiphase reaction zone consisting of flame and pressure front such as typically occurs during a combustion or even deflagration reaction leads to high temperatures of several 1000 K.

The notch charges are embodied such that a thermally activatable ignition charge increases the pressure locally as a result of the occurring reaction and ultimately leads to a shock-initiated, independent reaction in the notch charge after a run-up distance that depends on the explosive used and initiation pressure. As soon as this detonation front strikes the end of the notch charge facing toward the shell, the notch charge collapses and leads to a local weakening of the shell in the form of a notch effect. The notch can also consist of an insert made of a metal, plastic or any other inert material. Reactive inserts are also possible.

To artfully increase the initiation pressure and thus also reduce the overall length, the device can be damped with an inert material. An artful combination of the explosive of the notch charge and its plugging can have the effect of enabling an ignition charge to be omitted.

Moreover, the device can be surrounded with a single or several damping layers made of inert materials with shock-damping characteristics in order to prevent an undesirable sympathetic initiation of the blasting charge. This, in turn, helps to improve the IM characteristics in the case of thermal stimuli.

Figure 2:
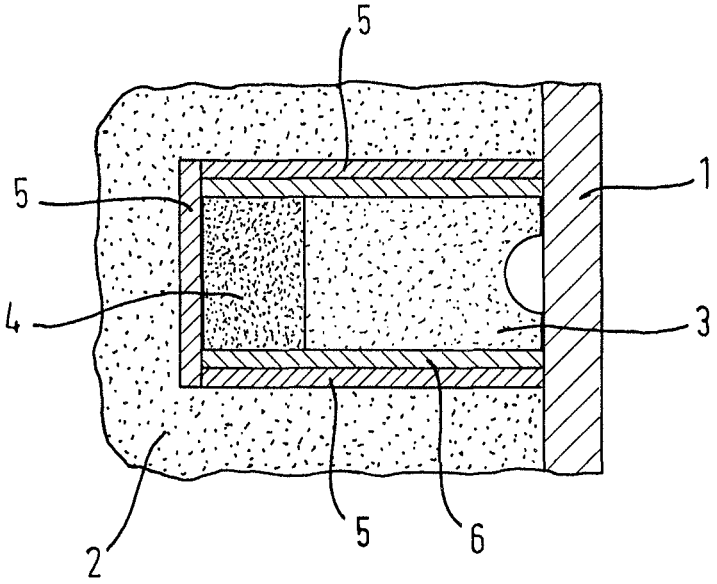
FIG. 2 depicts the cross section of the notch charge with ignition charge, plugging and damping layers arranged in front of an outer shell and embedded in a main charge.

FIG. 2 shows the cross section of the notch charge 3 with ignition charge 4, plugging 6 and damping 5 layers that is arranged in front of an outer shell 1 and is embedded in a main charge 2.

Figure 3:
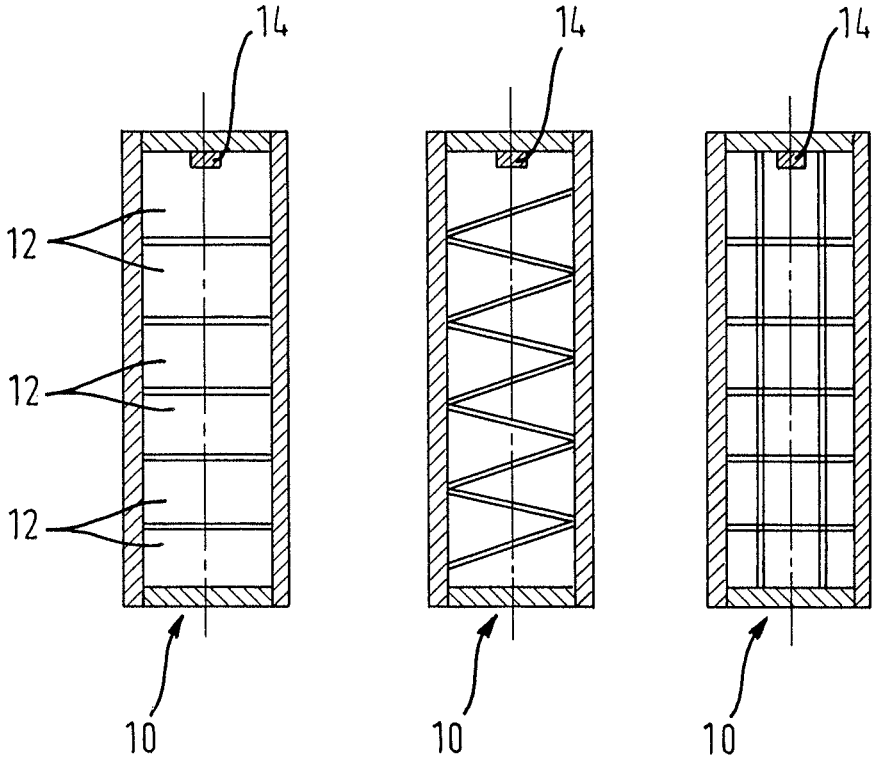
FIG. 3 depicts examples of notch charges, depicted on a cylindrical warhead, having various arrangements consistent with the principles of the invention.

Finally, these notch charges 12 can be arranged axially, transversely and/or obliquely to the warhead axis individually or several in parallel and/or crisscrossing layers in order to produce fragments of a desired size and mass. Examples of such arrangements can be found in FIG. 3, where they are depicted on a cylindrical warhead 10 having an initiation/deflagration device. However, any other shapes, such as convexly shaped warheads, for example, such as those typically used in bombs, artillery and mortar shells, are also possible.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for the controlled breakdown of a shell of a warhead, the device comprising:

a blasting charge configured to detonate a warhead having a shell comprising an interior surface opposing an exterior surface; and at least one temperature activated notch charge abutting the interior surface of the warhead shell, the notch charge comprising an energetic material and configured to activate upon exposure to a temperature provided by a combustion reaction of the blasting charge so as to effectuate a controlled breakdown of the warhead shell, wherein the notch charge has an insert made of an inert material, and wherein the insert is enriched with a reactive material.

2. The device as set forth in claim 1, wherein a cross section of the notch charge has one of a round and conical shape.

3. The device as set forth in claim 1, wherein a length of the notch charge is greater than a run-up distance at expected initiation pressures of an explosive of the notch charge.

4. The device as set forth in claim 1, wherein a diameter of the notch charge is greater than a typical critical diameter in a field of application of the notch charge, wherein an actual diameter of the blasting charge of the notch charge is selected to be smaller than a critical diameter of a blasting charge of the warhead so as to avoid a sympathetic initiation.

5. The device as set forth in claim 1, wherein the energetic material of the notch charge has an explosive molecule comprising at least one of RDX, HMX, PETN, HNS, Tetryl, and formulations thereof.

6. The device as set forth in claim 5, wherein a temperature-sensitive explosive, comprising the explosive molecule, is arranged upstream from the energetic material of the notch charge.

7. The device as set forth in claim 1, wherein the energetic material of the notch charge has a propellant charge substance comprising at least one of AP, AN, NM, NG, CP, PA, lead acid, and formulations thereof.

8. The device as set forth in claim 7, wherein a temperature-sensitive propellant charge, comprising the propellant charge substance, is arranged upstream from the energetic material of the notch charge.

9. The device as set forth in claim 1, wherein the energetic material of the notch charge is enriched with at least one of: metal particles, inert binders, reactive binders and additive substances.

10. The device as set forth in claim 1, wherein the energetic material of the notch charge is pressed.

11. The device as set forth in claim 1, wherein the energetic material of the notch charge is cast without hollow spaces.

12. The device as set forth in claim 1, wherein a density of the energetic material of the notch charge lies near or clearly below a theoretical maximum density.

13. The device as set forth in claim 1, wherein an ignition charge is arranged upstream from the energetic material of the notch charge.

14. The device as set forth in claim 13, wherein the ignition charge has a pyrotechnic formulation comprising at least one of $KNO_3$, Zr, $Pb_3O_4$, tetrazene, boron and strontium nitrate with Mg and additives, wherein the ignition charge is arranged upstream from the energetic material of the notch charge.

15. The device as set forth in claim 13, wherein the ignition charge can be ignited by means of a hot gas.

16. The device as set forth in claim 13, wherein at least one of the notch charge and the ignition charge are damped with one or more layers of an inert material.

17. The device as set forth in claim 16, wherein a plastic or another inert and shock-damping material can be used for damping.

18. The device as set forth in claim 13, wherein a damping layer of inert material is arranged between the blasting charge, the ignition charge and the notch charge.

19. The device as set forth in claim 1, wherein one or more notch charges are arranged on an interior of the shell of the warhead perpendicularly or obliquely to a shell surface.

20. The device as set forth in claim 19, wherein the one or more notch charges are at least one of axially, transversely and obliquely arranged with respect to a main axis of the warhead in one or more of individually, several in parallel and in crisscrossing layers.

21. The device as set forth in claim 20, wherein a spacing of a plurality of notch charges that are parallel and crossing at an angle can be established according to desired fragment sizes.

22. A method for the controlled breakdown of a shell of a warhead, the method comprising:

denotatively igniting a notch charge abutting an interior surface of a warhead shell, the interior surface opposing an exterior surface, by exposing the notch charge to a high temperature under exploitation of a deflagration-to-detonation transition effect provided by a combustion reaction of a blasting charge of the warhead, which blasting charge is configured to detonate the warhead, wherein the shell is weakened by a notch effect such that a controlled breakdown into fragments is enabled, wherein the notch charge has an insert made of an inert material, and wherein the insert is enriched with a reactive material.

23. The method as set forth in claim 22, wherein denotatively igniting the notch charge is achieved by means of the deflagration-to-detonation transition effect via producing a reaction and pressure by exposing an upstream ignition charge to the high temperature.

* * * * *